US006816756B2

(12) United States Patent
Shin et al.

(10) Patent No.: US 6,816,756 B2
(45) Date of Patent: Nov. 9, 2004

(54) PAINT FILM THICKNESS PREDICTING METHOD AND SYSTEM FOR ACTUAL CAR, AND RECORDING MEDIUM

(75) Inventors: Kenei Shin, Tokyo (JP); Toru Komoriya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/390,716

(22) Filed: Mar. 19, 2003

(65) Prior Publication Data

US 2003/0182006 A1 Sep. 25, 2003

(30) Foreign Application Priority Data

Mar. 20, 2002 (JP) ..... P. 2002-078283

(51) Int. Cl.[7] ..... B05D 1/00

(52) U.S. Cl. ..... 700/283; 427/8; 427/9; 427/469

(58) Field of Search ..... 700/283; 427/8, 427/9, 469

(56) References Cited

U.S. PATENT DOCUMENTS 4,968,530 A * 11/1990 Yamane et al. ..... 427/142

* cited by examiner

*Primary Examiner*—Albert W. Paladini
*Assistant Examiner*—Charles Kasenge
(74) *Attorney, Agent, or Firm*—McGinn & Gibb, PLLC

(57) ABSTRACT

A paint film thickness predicting method for an actual car, which predicts a paint film thickness of an object car in an actual car state, an electrodeposition coating being applied to the object car by using an electrodeposition coating line, has a calculating an analyzed value of the paint film thickness of a constituent member constituting a part of the object car by executing electrodeposition coating analysis by using a computer, and a predicting the paint film thickness of the object car in the actual car state from the analyzed value of the paint film thickness by the computer, wherein the correlation predicting expression stipulates a correlation between the paint film thickness of a mass-produced car in the actual car state and an analyzed value of the paint film thickness of the constituent member.

22 Claims, 8 Drawing Sheets

PAINT FILM THICKNESS PREDICTING METHOD AND SYSTEM FOR ACTUAL CAR, AND RECORDING MEDIUM

BACKGROUND OF THE INVENTION

1. Field of the Invention

The present invention relates to an approach of predicting a paint film thickness of an actual car, which is formed by the electrodeposition coating, without the execution of electrodeposition coating analysis on the vehicle model base, particularly to make it possible to predict a paint film thickness of an actual car without the execution of electrodeposition coating analysis on the vehicle model base, and to make it possible to calculate effectively a paint film thickness of an actual car by achieving reduction in an amount of operation required for the prediction of the paint film thickness of the actual car.

2. Description of the Related Art

The electrodeposition coating is such a coating method that utilizes the electrophoresis phenomenon of the polyelectrolyte, the electrodialysis phenomenon, etc. Since this coating can cause the paint film to adhere uniformly to surface of the coated object and is excellent in the anticorrosion property, such coating is used widely as the undercoating of various members such as the vehicle body, parts. From viewpoints of rust preventing measure, reduction in the paint consumption, lighter weight of the members, etc., it is an important design subject to suppress a paint film thickness, which has adhered to the surface of the member by the electrodeposition coating, within a predetermined range. Therefore, it becomes important to analyze and study the paint film separation state by electrodeposition coating analysis. In the prior art, the paint film thickness of the actual car is predicted/evaluated by executing the electrodeposition coating analysis while using the vehicle model whose vehicle shape is expressed by meshes.

However, if the electrodeposition coating analysis is to be executed on the vehicle model base, first the analyzing mesh that expresses shapes of individual members in the vehicle by the meshes must be generated. For example, vehicle meshes of the overall actual car containing all members are generated by superposing/extending the member meshes, which express shapes of individual members in the vehicle by the meshes, to the overall vehicle. In this case, since the member meshes are overlapped with each other on the overall vehicle, the number of meshes in complicated vehicle meshes is increased enormously. Also, an amount of computation required for the electrodeposition coating analysis of the overall vehicle becomes enormous. Therefore, in order to execute the mesh generation and analysis effectively, the high processing ability is required of the computer. However, since the processing abilities of the personal computers that are spread normally have their limitation, it takes much time to generate the analyzing meshes of the vehicle model or to predict an amount of paint film on the vehicle base.

SUMMARY OF THE INVENTION

The present invention has been made in light of such circumstances and it is an object of the present invention to make it possible to predict a paint film thickness of an actual car without the execution of electrodeposition coating analysis on the vehicle model base.

Also, it is another object of the present invention to make it possible to calculate effectively a paint film thickness of an actual car by achieving reduction in an amount of operation required for the prediction of the paint film thickness of the actual car.

In order to overcome such subject, a first aspect of the present invention provides a paint film thickness predicting method for an actual car, which predicts a paint film thickness of an object car in an actual car state, an electrodeposition coating being applied to the object car by using an electrodeposition coating line, having a calculating an analyzed value of the paint film thickness of a constituent member constituting a part of the object car by executing electrodeposition coating analysis by using a computer, the constituent member being employed as an analyzed object in the electrodeposition coating analysis, and a predicting the paint film thickness of the object car in the actual car state from the analyzed value of the paint film thickness by the computer based on a previously-prepared correlation predicting expression, wherein the correlation predicting expression stipulates a correlation between the paint film thickness of a mass-produced car, to which the electrodeposition coating has already been applied in an electrodeposition coating line by which the electrodeposition coating is applied to the object car, in the actual car state and an analyzed value of the paint film thickness of the constituent member, which is obtained by the electrodeposition coating analysis that is applied to the constituent member constituting a part of the mass-produced car as the analyzed object. At that time, it is preferable that the constituent member constituting a part of the mass-produced car is same as the constituent member constituting apart of the object car, improvement in the prediction precision of the paint film thickness can be achieved.

Here, in the above calculating, a function using at least the analyzed value of the paint film thickness of the constituent member as an input variable may be employed as the correlation predicting expression. Also, in the predicting, a neural network using at least the analyzed value of the paint film thickness of the constituent member as an input variable may be employed as the correlation predicting expression.

Also, it is preferable that the predicting further comprises an executing correction of the paint film thickness of the object car, which was calculated based on the correlation predicting expression, in the actual car state under consideration of electrodeposition equipment conditions or electrodeposition solution characteristics.

In this case, it is desired that the executing correction is executed by using a neural network that employs at least the electrodeposition equipment conditions or the electrodeposition solution characteristics as the input variable.

Also, it is preferable that the calculating includes, a generating analysis meshes of the constituent member, and an applying a process preventing an electrodeposition solution from entering from an outside to the analysis meshes.

A second aspect of the present invention provides a paint film thickness predicting system for an actual car, which predicts a paint film thickness of an object car in an actual car state, an electrodeposition coating being applied to the object car by using an electrodeposition coating line, having a memory device for storing a correlation predicting expression that stipulates a correlation between the paint film thickness of a mass-produced car, to which the electrodeposition coating has already been applied in an electrodeposition coating line by which the electrodeposition coating is applied to the object car, in the actual car state and an analyzed value of the paint film thickness of the constituent member, which is obtained by electrodeposition coating analysis that is applied to the constituent member constituting a part of the mass-produced car as the analyzed object, and a computer for calculating an analyzed value of the paint film thickness of a constituent member constituting a part of the object car by executing the electrodeposition coating analysis, in which the constituent member is employed as an analyzed object, and then predicting the paint film thickness of the object car in the actual car state from the analyzed value of the paint film thickness based on the correlation predicting expression. At that time, if the constituent member constituting a part of the mass-produced car is same as the constituent member constituting a part of the object car, improvement in the prediction precision of the paint film thickness can be achieved.

A third aspect of the present invention provides a recording medium for recording a program that causes a computer to execute a paint film thickness predicting method for an actual car, which predicts a paint film thickness of an object car in an actual car state, an electrodeposition coating being applied by using an electrodeposition coating line, the paint film thickness predicting method for an actual car, having a calculating an analyzed value of the paint film thickness of a constituent member constituting a part of the object car by executing electrodeposition coating analysis by using the computer, the constituent member being employed as an analyzed object in the electrodeposition coating analysis, and a predicting the paint film thickness of the object car in the actual car state from the analyzed value of the paint film thickness by the computer based on a previously-prepared correlation predicting expression, wherein the correlation predicting expression stipulates a correlation between the paint film thickness of a mass-produced car, to which the electrodeposition coating has already been applied in an electrodeposition coating line by which the electrodeposition coating is applied to the object car, in the actual car state and an analyzed value of the paint film thickness of the constituent member, which is obtained by the electrodeposition coating analysis that is applied to the constituent member constituting a part of the mass-produced car as the analyzed object. At that time, if the constituent member constituting a part of the mass-produced car is same as the constituent member constituting a part of the object car, improvement in the prediction precision of the paint film thickness can be achieved.

DETAILED DESCRIPTION OF THE PREFERRED EMBODIMENTS (System Configuration)

Figure 1:
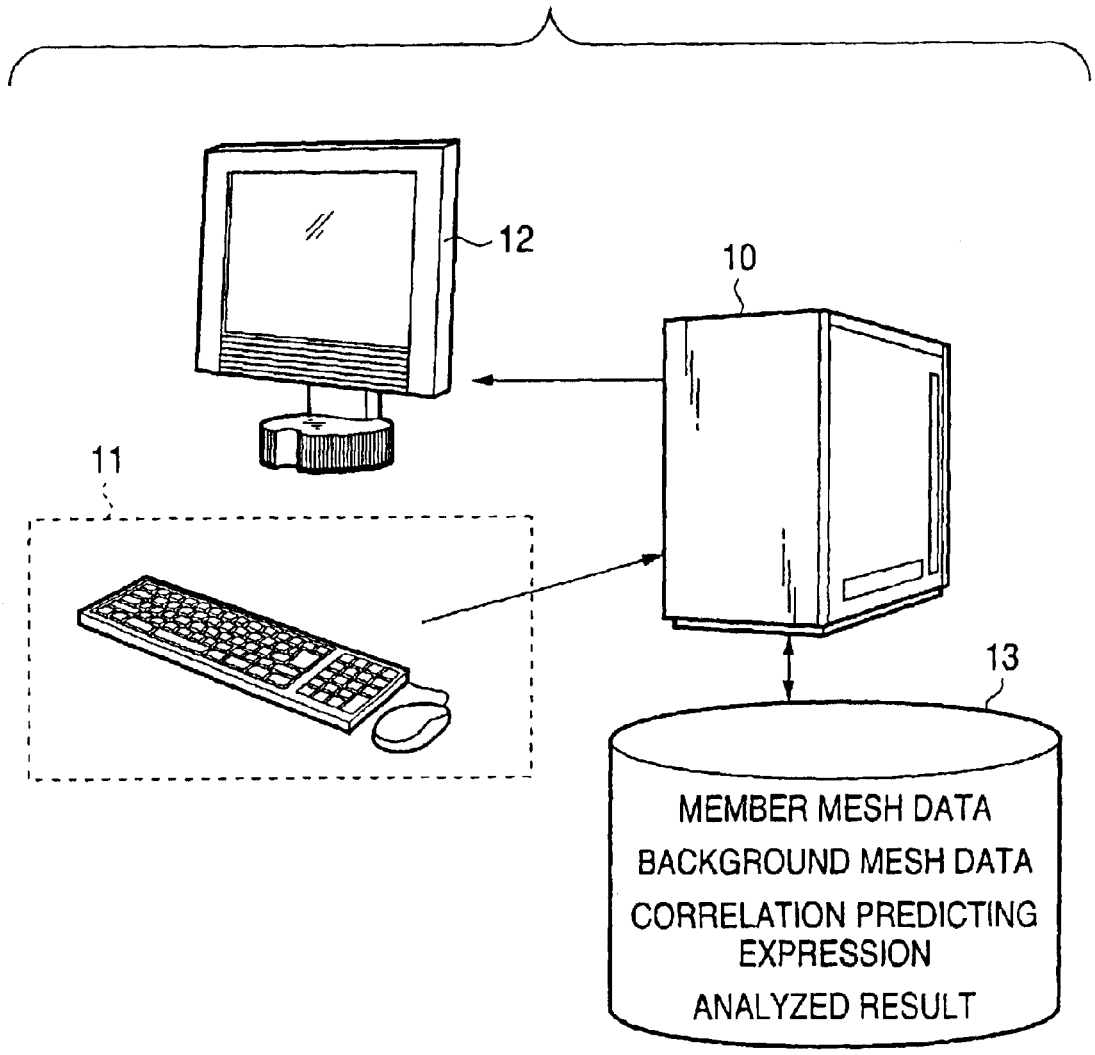
FIG. 1 is a configurative view showing a paint film thickness predicting system for an actual car.

FIG. 1 is a configurative view showing a paint film thickness predicting system for an actual car according to the present embodiment. The paint film thickness for the actual car, to which the electrodeposition coating is applied by using the electrodeposition coating line, is predicted in the actual car state by using this system. This system comprises a computer 10, an input device 11 such as a key board, a mouse, or the like, a display device 12 such as CRT, a liquid crystal display, or the like, and a memory device 13 such as a magnetic disk, or the like. The computer 10 is the well-known one consisting of CPU, RAM, ROM, input/output interface, etc. This computer 10 executes the electrodeposition coating analysis of a constituent member (single body of the member or assembled body of plural members) constituting a part of the actual car as the analyzed object (object car) and predicts the paint film thickness at the actual car level on the electrodeposition coating line of this object car based on the analyzed result (analyzed value of the paint film thickness). The operator executes the designation of the constituent member serving as the analyzed object, the input of numerical values, etc. by operating the input device 11 based on the information displayed on the display device 12.

Member mesh data that express the constituent members constituting a part of the object car by the meshes, background mesh data that express the coating environment by the meshes, etc. are stored in the memory device 13. These data are used in executing the electrodeposition coating analysis on the constituent member base. Also, a correlation predicting expression to be described later is stored in the memory device 13. The paint film thickness of the object car at the actual car level is calculated uniquely based on the analyzed result on the constituent member base by using this correlation predicting expression. In this case, the analyzed results of the electrodeposition coating generated in the course of the computer process, to be described later, is also stored in the memory device 13.

Figure 2:
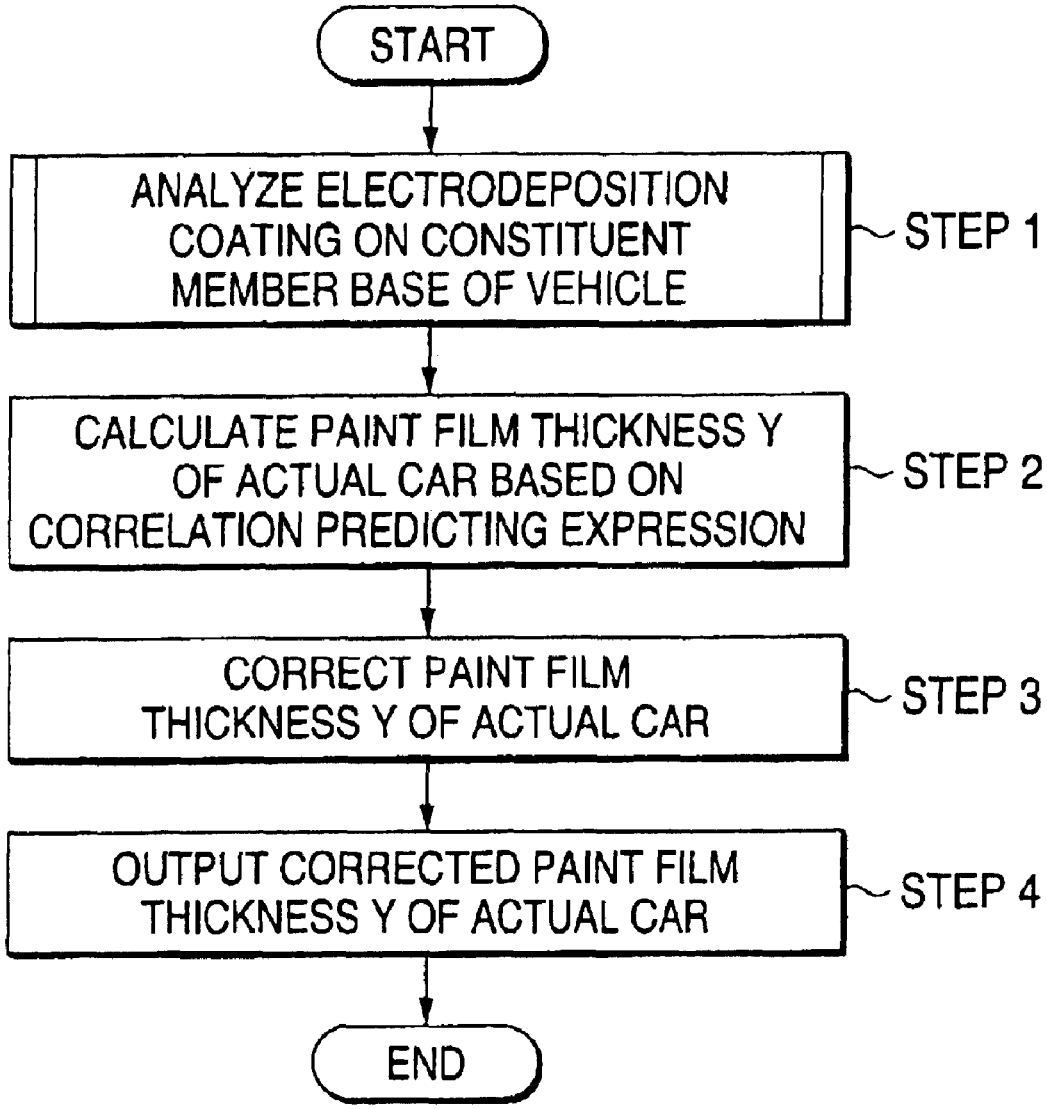
FIG. 2 is a flowchart showing procedures of predicting a paint film thickness of the actual car.

FIG. 2 is a flowchart showing procedures of predicting the paint film thickness of the actual car. First, in step 1, the electrodeposition coating analysis is applied to a certain constituent member of the object car (single body of the member or assembled body of plural members) as the analyzed object on the constituent member base of the vehicle using the standard paints. As this analyzed result, a paint film thickness X of the constituent member (analyzed value of the paint film thickness) is calculated.

Figure 3:
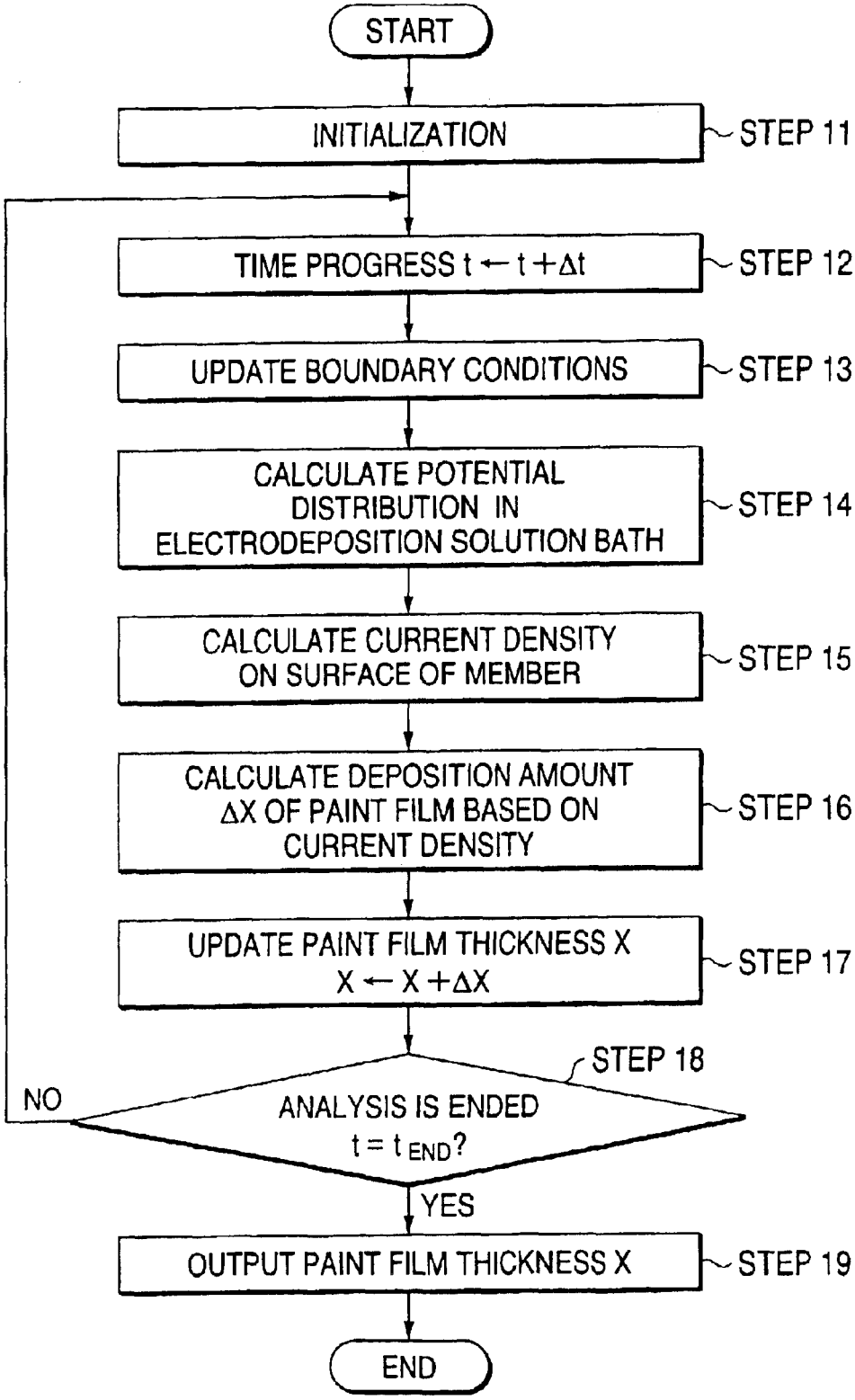
FIG. 3 is a flowchart showing the electrodeposition coating analysis on the constituent element base.

FIG. 3 is a flowchart showing an example of the electrodeposition coating analysis on the constituent element base. Since these analyzing procedures themselves are well known, they will be explained schematically hereunder. First, in step 11, initialization is executed. In this step, the analyzing mesh of the objective portion (e.g., front pillar, a center pillar, or the like) is input, and also boundary conditions and computation conditions are set. In order to prevent an electrodeposition solution from entering into the inside of the assembled body of members from the cutting plane of the member, the end-face correction that corresponds to the packing, the lid, or the like in computation is applied to the cut-out constituent member as the analyzed object (test piece) before the analysis is executed on the constituent element base. Since the process of preventing the entering of the electrodeposition solution from the outside is applied, improvement of the analysis precision can be achieved.

In step 12, a time step in computation is advanced by Δt. Then, in step 13, potential boundary conditions such as an electrode voltage, etc. at a current time t are updated. Then, a potential distribution in an electrodeposition solution bath is calculated by solving the potential diffusion equation according to finite volume method, finite element method, finite difference method, or the like (step 14). Then, while taking account of the film thickness resistance of the paint that is adsorbed onto the surface of the member, a current density on a surface of the member is calculated based on the resultant potential distribution (step 15). Then, a deposition amount ΔX of the paint film on the surface of the member is calculated based on the current density according to the prediction expression between the current density and the paint film thickness, which has been previously checked by the basic experiment, or the like (step 16) Then, in step 17, the paint film thickness X is updated by adding the deposition amount ΔX, which is calculated at this time, to the preceding paint film thickness X (paint film thickness before one time step) (this thickness corresponds to the paint film thickness at a current time t). Then, in step 18, the current time t and the analysis end time $t_{END}$ are compared with each other to decide whether or not the analysis is ended. If the current time t does not come up to the analysis end time $t_{END}$, the process goes back to step 12 and then procedures in steps 12 to 18 are executed repeatedly until the current time t reaches the analysis end time $t_{END}$. When the current time t comes up to the analysis end time $t_{END}$ in due course, the process goes from step 18 to step 19 where the paint film thickness X is output. Thus, the electrodeposition coating analysis is ended.

In step 2 that is subsequent to step 1 in FIG. 2, a paint film thickness Y in the actual car state of the object car is calculated from the paint film thickness X, which is calculated by the electrodeposition coating analysis on the constituent element base, based on the correlation predicting expression that is set in advance in the memory device 13. Here, the constituent element base signifies that not the overall object car but one constituent member constituting a part of the object car is set as the analyzed object. Also, this correlation predicting expression defines the correlation between the paint film thickness of the "mass-produced car" in the actual car state and the analyzed value of the paint film thickness of the constituent member constituting a part of the "mass-produced car". Here, the "mass-produced car" means the car electrodeposition coating of which has already been executed in the electrodeposition coating line that is going to apply the electrodeposition coating to the object car. For example, the preceding car or the resemble car may be listed as the "mass-produced car". In other words, the mass-produced car means not the actual car itself whose paint film state is to be predicted at this time but the car electrodeposition coating of which has already been executed in the same electrodeposition coating line. Also, the analyzed value of the paint film thickness of the constituent member of the mass-produced car can be obtained by applying the electrodeposition coating analysis to this constituent member as the analyzed object. In this case, it is preferable that, in order to achieve the improvement of the prediction precision, the constituent member of the mass-produced car should be set to the same member as that of the object car.

The correlation predicting expression is set by one of approaches 1 and 2 described in the following.

(Approach 1)

Figure 4:
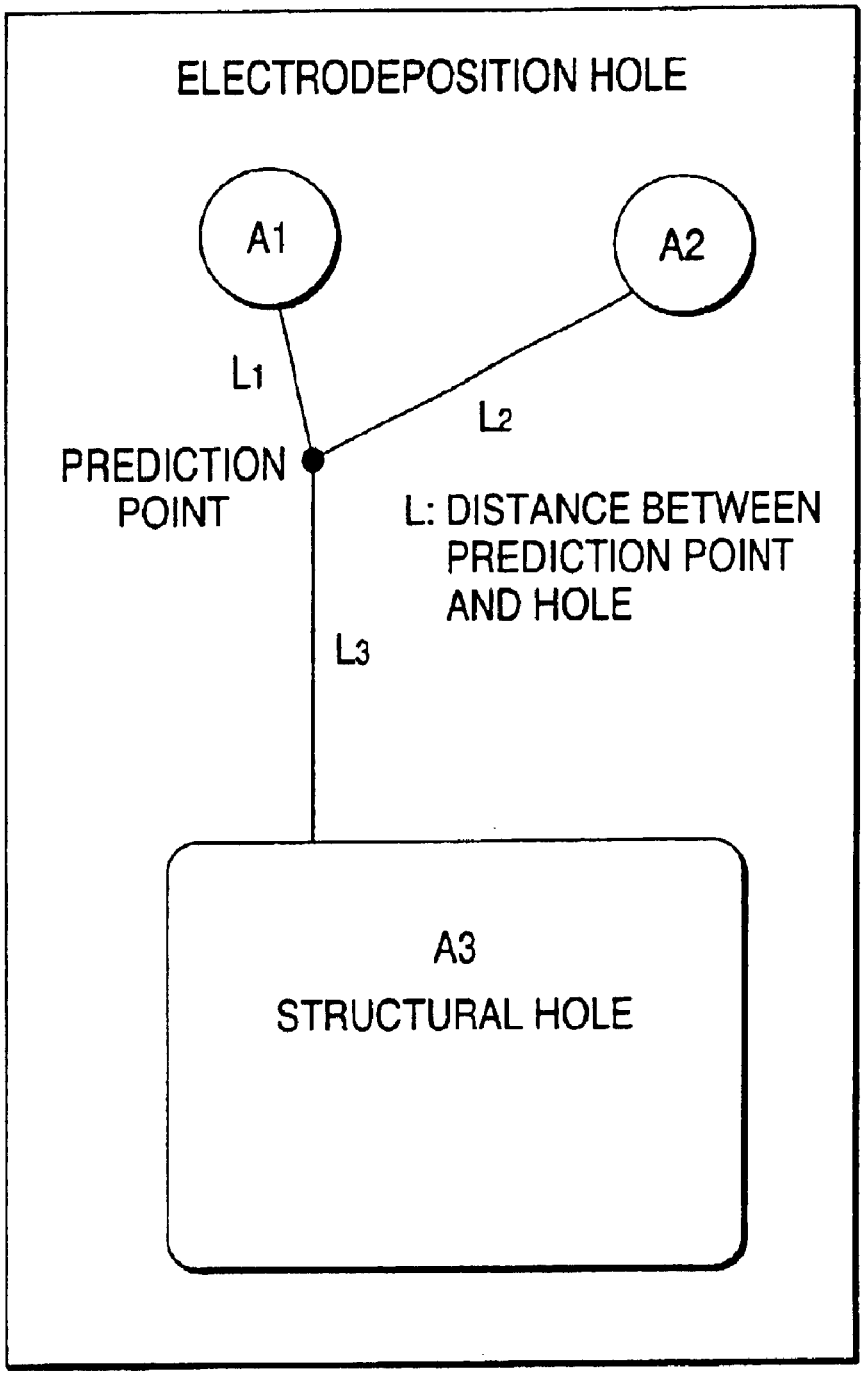
FIG. 4 is an explanatory view showing input variables in a correlation predicting expression.
Figure 5:
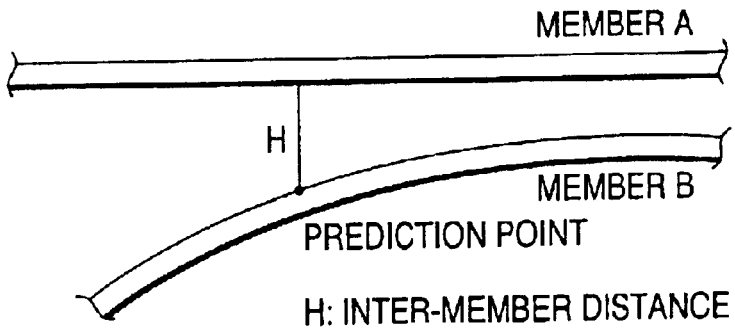
FIG. 5 is an explanatory view showing input variables in the correlation predicting expression.

A multiple correlation function f (X, L, A, H . . . ) given by a following expression is employed as the correlation predicting expression (X, L, A, H are input variables, and C0 to C4 are coefficients).

$$Y=C0+C1\cdot X+C2\cdot L+C3\cdot A+C4\cdot H+ \quad \text{(Expression 1)}$$

Where the variable Y is the paint film thickness (deposition amount of the paint film) of the mass-produced car in the actual car state, and the variable X is the deposition amount of the paint film of the constituent member constituting a part of the mass-produced car (paint film thickness obtained by the electrodeposition coating analysis on the constituent member base). Also, the variable L is a distance between a prediction point and a hole (electrodeposition hole or structural hole), the variable A is a hole area as the object of the variable L, and the variable H is an inter-member distance. For example, as shown in FIG. 4, if two electrodeposition holes and the structural hole are formed in a certain member, distances L1, L2, L3 from the prediction point and three holes serve as the input variables and three hole areas A1, A2, A3 serve as the input variables. Also, as shown in FIG. 5, a distance H between two mutually-opposed members A, B is identified as a distance from the prediction point on the member B side to the member A.

In this case, in the expression 1, the variable X is an indispensable input variable. But all the variables L, A, H are not always needed as the input variables, and may be applied appropriately selectively in connection with the prediction precision.

The paint film thickness Y (deposition amount of the paint film) in the actual car state is calculated uniquely based on the correlation predicting expression in which the paint film thickness X of the constituent member, which is calculated by the electrodeposition coating analysis on the constituent member base, is used as the indispensable input variable. As can be understood from such a relationship that the paint film thickness Y of the actual car becomes thicker as the paint film thickness X of the constituent member becomes thicker, there is the clear correlation between both variables X, Y. As a result, if values of the coefficients C0 to C4 are set appropriately through the experiment, the simulation, etc., the paint film thickness Y of the actual car on the electrodeposition coating line of the actual car (the paint film thickness in the actual car state) can be predicted from the paint film thickness X on the constituent member base.

In this case, in the correlation predicting expression, a table that describes the correlation the input variables X1 to X4 and the deposition amount Y of the paint film may be employed in place of the multiple correlation function f in Expression 1. Also, a plurality of multiple correlation functions f are prepared previously, and then the appropriate one may be applied selectively in response to individual electrodeposition coating case.

(Approach 2)

Figure 6:
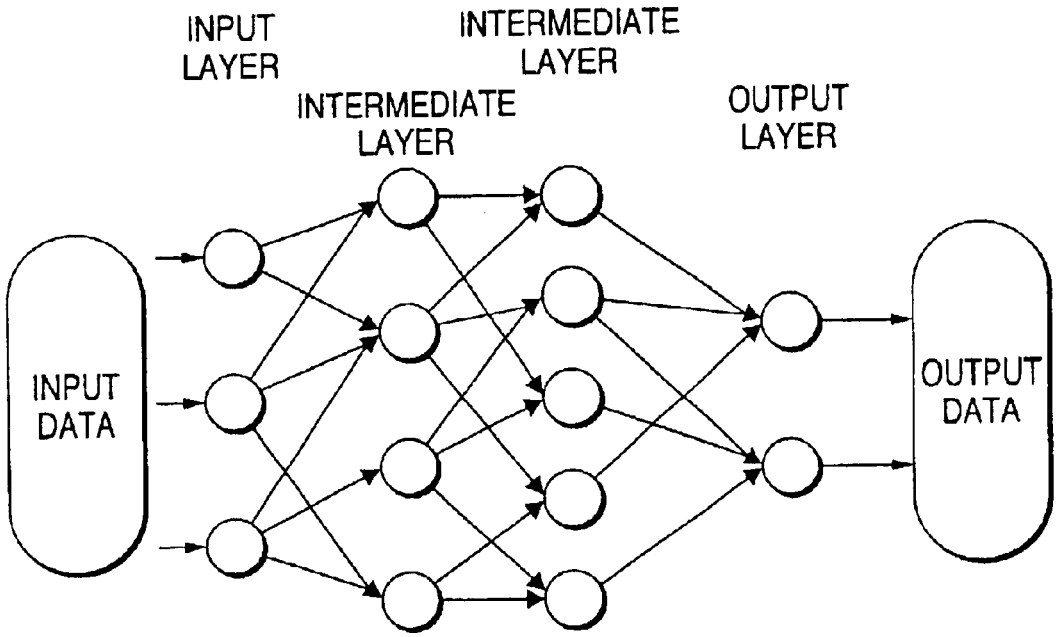
FIG. 6 is a view showing a basic configuration of a normal neural network.

A neural network is utilized as the correlation predicting expression. FIG. 6 is a view showing a basic configuration of the normal neural network. In the hierarchical neural network that consists of the input layer, the intermediate layers, and the output layer, respective layers are composed of a plurality of elements having the same function. Respective elements are coupled by proper weight coefficients wij.

Figure 7:
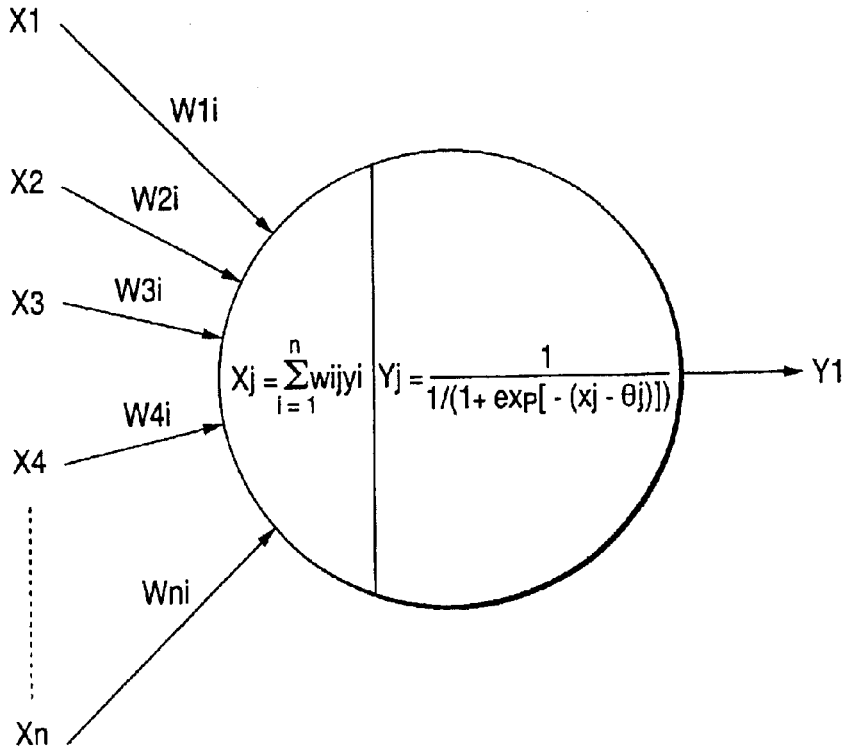
FIG. 7 is an explanatory view showing an inner configuration of an element.

FIG. 7 is an explanatory view showing an inner configuration of the element. Each element executes calculations shown in Expressions 2, 3 with respect to input data yi and then calculated results are output as output data Yj. Where wij is the weight coefficient between the i-th element and the j-th element, and θj is a threshold value.

$$X_j = \sum_{i=1}^{n} w_{ij} y_i \quad \text{(Expression 2)}$$

$$Y_j = \frac{1}{1 + \exp[-(X_j - \theta_j)]} \quad \text{(Expression 3)}$$

Figure 8:
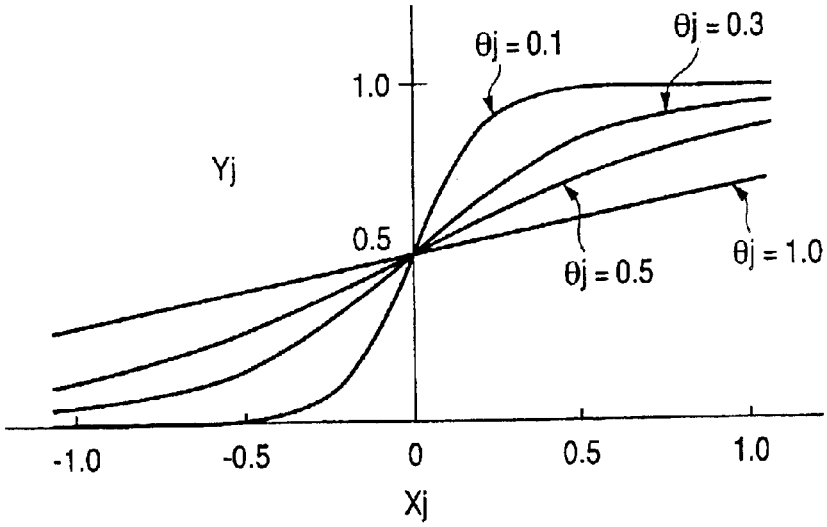
FIG. 8 is a view showing an input/output characteristic diagram of the sigmoid function.

Expression 3 is called the sigmoid function and is employed commonly as the function of the neural network element. FIG. 8 is a view showing an input/output characteristic diagram of the sigmoid function. As can be seen from this characteristic diagram, the sigmoid function changes continuously from 0 to 1 and comes closer to the step function as the threshold value θj is reduced smaller.

In order to achieve the improvement of the precision of the estimated results by the neural network, the weight coefficient wij and the threshold value θj must be adjusted appropriately. This adjustment (called also the "learning") is carried out by the approach that is called the Back-Propagation method. This method prepares the teacher's data previously, then proceeds the learning such that the result coincides with the teacher's data, and then decides the weight coefficient wij and the threshold value θj. Both initial values of the weight coefficient wij and the threshold value θj are given by the random number. The input data are input into the input layer element of the neural network, and then an error E expressed by following Expression 4 is calculated by comparing the output result from the output layer element with the value of the teacher's data. Where Yk is the output value of the output element of the neural network, Dk is a desired output value, and n is the number of the teacher's data.

$$E = \sum_{i=1}^{n} (Y_k - D_k)^2 / 2 \quad \text{(Expression 4)}$$

Then, contribution rates ∂E/∂wij, ∂E/∂θj of the weight coefficients wij and the threshold values θj with respect to the error E calculated by Expression 4 are calculated respectively. Also, variations Δwij(t+1) of respective weight coefficients and variations Δθj(t+1) of the threshold values are calculated based on Expressions 5, 6.

$$\Delta w_{ij(t+1)} = -\alpha \frac{\partial E}{\partial w_{ij}} + \beta \Delta w_{ij(t)} \quad \text{(Expression 5)}$$

$$\Delta \theta_{j(t+1)} = -\gamma \frac{\partial E}{\partial \theta_j} + \varepsilon \Delta \theta_{j(t)} \quad \text{(Expression 6)}$$

Where α, β, γ, ϵ are constants, and assume that α=γ=0.1 and β=ϵ=0.9. Also, Δwij(t) is an amount of correction of the weight coefficient prior to the leaning, and Δθj(t) is an amount of correction of the threshold value prior to one leaning step. The leaning is carried forward by repeating the correction of the weight coefficients wij and the threshold values θj. The number of times of the learning is set to more than 500 per one teacher's data.

Figure 9:
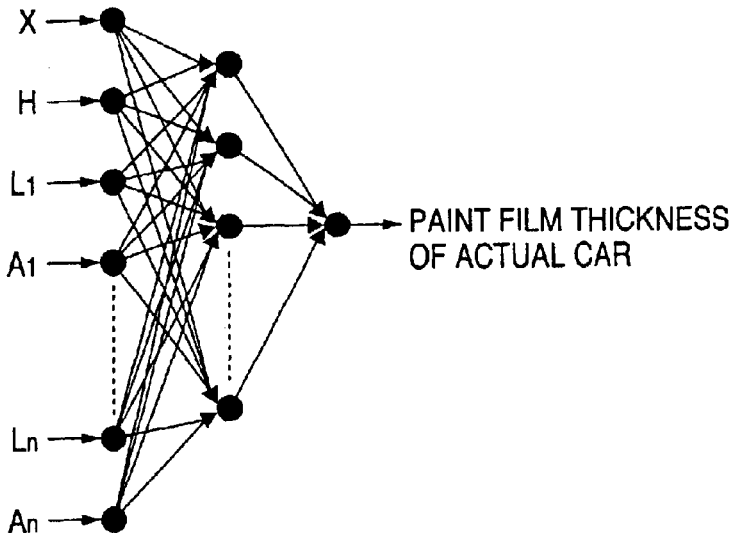
FIG. 9 is a configurative view showing a neural network for predicting the paint film thickness for the actual car.

FIG. 9 is a configurative view showing a neural network for predicting the paint film thickness for the actual car. Like three-layered model shown in FIG. 9, the number of elements in the input layer of more than 2 is needed. The distance L between the prediction point and the hole (electrodeposition hole or structural hole), the hole area A as the object of L, the inter-member distance H, etc. are set in addition to the paint film thickness X as the analyzed result on the constituent member base. In this case, like the above approach 1, all the distance L, the hole area A, and the inter-member distance H are not always input, and appropriate variables may be applied as the case may be. Also, since there is no theoretical method of calculating the number of elements in the intermediate layer, the appropriate number is set after it is checked how the estimating precision is changed when the number of elements in the intermediate layer is changed. The output from the element in the output layer corresponds to the paint film thickness Y at the actual car level (deposition amount of the paint film).

In this approach 2, the paint film thickness Y of the actual car is calculated by using the neural network, which uses the paint film thickness X of the constituent member calculated by the electrodeposition coating analysis in step 1 as the indispensable input and also uses the distance L, the hole area A, and the inter-member distance H as inputs appropriately. Since the neural network that is suitable for the prediction of the nonlinear phenomenon is employed, the prediction precision of the paint film thickness Y of the actual car can be improved rather than the case where the multiple correlation function f in the approach 1 is employed.

Figure 10:
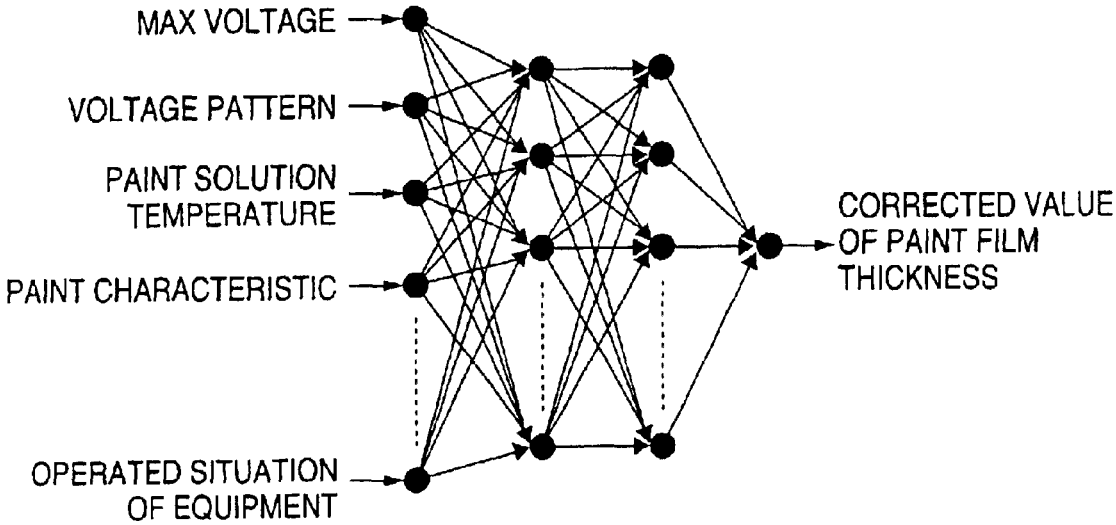
FIG. 10 is a configurative view showing a neural network for calculating a corrected value; and, FIG. 11 is a configurative view showing a unified neural network.

In step 3, the paint film thickness Y of the actual car obtained in step 2 is corrected as the case may be. Here, the corrected value is calculated based on the multi-dimensional function, the neural network, or the like, which takes account of differences in voltage pattern, paint characteristic, etc., and then the paint film thickness is corrected by using this corrected value. FIG. 10 is a configurative view showing the neural network for calculating the corrected value. As inputs, there are contained electrodeposition equipment conditions such as maximum voltage (max voltage) of the electrodeposition coating, voltage pattern, operated situation of the equipment, etc., and electrodeposition solution conditions such as paint solution temperature, paint characteristic, etc. In this manner, if the neural network that employs the electrodeposition equipment conditions, the electrodeposition solution characteristic, etc. as the inputs is applied, the optimum corrected value suitable for the actual circumstances can be found and also such neural network can be applied even when the electrodeposition equipment conditions and the electrodeposition solution are changed.

Figure 11:
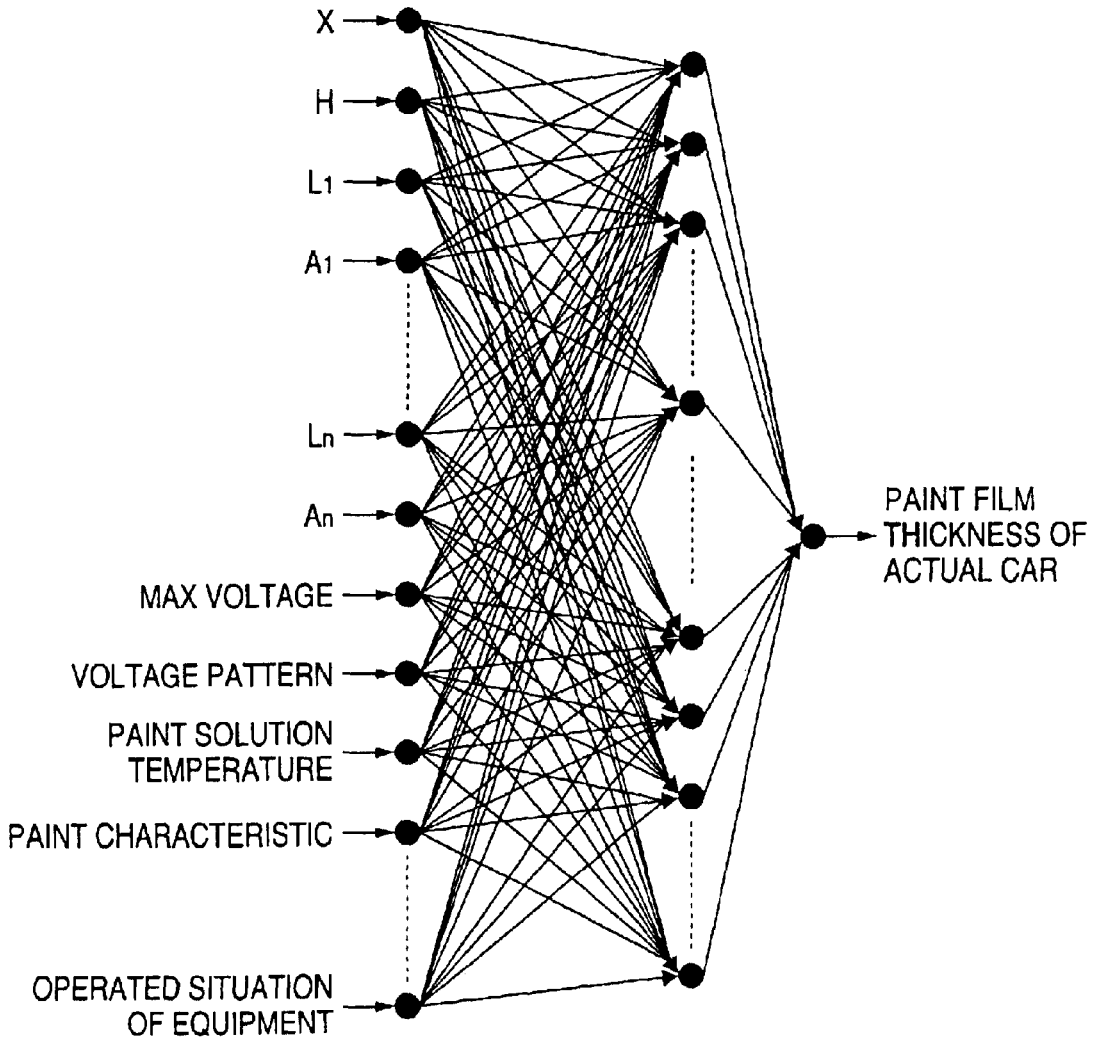

Also, if the neural network is used as the correlation predicting expression and also the neural network for the corrected value is used, a configuration of a unified neural network shown in FIG. 11 may be employed. In this case, the input is of the mode in which the electrodeposition equipment conditions and the paint characteristic are added to the paint film thickness X of the constituent member, the inter-member distance H, the distance L, and the hole area A. If such configuration is employed, the paint film thickness Y of the actual car with high prediction precision can be detected at a time and the correcting process in step 3 can be omitted.

Then, the paint film thickness Y of the actual car corrected in step 4 subsequent to step 3 is output. Thus, the process is ended.

In the present embodiment, the paint film thickness X at the constituent member level is calculated by executing the electrodeposition coating analysis of the objective constituent member while using the analysis mesh of this constituent member. The paint film thickness X at the constituent member level and the paint film thickness Y at the vehicle level have the correlation. Therefore, if the relationship between both thicknesses is detected in advance as the correlation predicting expression through the experiment, the simulation, etc., the paint film thickness Y of the actual car on the actual electrodeposition coating line can be predicted effectively without execution of the electrodeposition coating analysis on the vehicle model base.

Also, generation of the complicated analysis mesh of the vehicle model is not needed, and also execution of the electrodeposition coating analysis on the vehicle model base is not needed. If the electrodeposition coating analysis on the constituent member base an amount of computation of which is relatively small is executed, the paint film thickness Y at the actual car level can be calculated quickly. Therefore, it is possible to predict effectively the paint film thickness Y of the actual car even by the personal computer whose processing ability is not so high.

In addition, since there is no necessity that the electrodeposition coating test of the single body of the member should be executed, reduction in cost and reduction in time can be achieved. In particular, in the present embodiment, while using already-accumulated data, the correlation predicting expression is set to the mass-produced car, which is coated by the electrodeposition coating on the same electrodeposition coating line, prior to the object car as the analyzed object. This correlation predicting expression is satisfactorily reflective of the characteristics peculiar to the objective electrodeposition coating line (e.g., flow of the paint, position of the electrodes, etc.). As a result, if the correlation predicting expression of the mass-produced car, to which the electrodeposition coating is applied actually in advance, is applied to the object car to which the electrodeposition coating is to be applied hereafter on the same electrodeposition coating line, the paint film thickness Y in the actual car state of the object car can be predicted satisfactorily. At that time, if the constituent member of the object car is set identically to the constituent member of the mass-produced car, the prediction precision of the paint film thickness can be improved much more.

In this case, since structural difference between the object car and the mass-produced car cannot be reflected in the correlation predicting expression, the paint film thickness due to the structural difference cannot be evaluated by the correlation predicting expression itself. However, in the present embodiment, the input variable X of the correlation predicting expression is calculated by the electrodeposition coating analysis that employs the constituent member of the object car as the analyzed object. This input variable X reflects the structural difference between the object car and the mass-produced car. Therefore, the paint film thickness in the actual car state of the object car can be detected with good precision by the correlation predicting expression that is identified based on accumulated data of different car type.

In this case, the recording medium for recording a computer program to implement functions of the above embodiment may be supplied to the system having the configuration in FIG. 1. In this case, the object of the present invention can be achieved when the computer 1 in this system reads and executes the computer program stored in the recording medium. Therefore, since the computer program itself, which is read from the recording medium, can implement new functions of the present invention, the recording medium for recording the computer program constitutes the present invention. As the recording medium for recording the computer program, there may be listed CD-ROM, flexible disk, hard disk, memory card, optical disk, DVD-ROM, DVD-RAM, etc., for example. Also, the computer program itself, which can implement the functions of the above embodiment, has the new function.

According to the present invention, even if the electrodeposition coating analysis on the vehicle model base is not executed, the paint film thickness of the actual car can be calculated uniquely based on results of the electrodeposition coating analysis of the objective constituent member. Therefore, not only the generation of the analysis mesh of the vehicle model but also the execution of the electrodeposition coating analysis on the vehicle model base is not needed. As a result, the paint film thickness of the actual car can be predicted effectively by a small amount of computation.

The disclosure of Japanese Patent Application No. 2002-078283 filed on Mar. 20, 2002 including the specification, drawings and abstract is incorporated herein by reference in its entirety.

While the presently preferred embodiments of the present invention have been shown and described, it is to be understood that these disclosures are for the purpose of illustration and that various changes and modifications may be made without departing from the scope of the present invention as set forth in the appended claims.

What is claimed is:

1. A paint film thickness predicting method for an object car, the method comprising:

calculating the paint film thickness of a constituent member of the object car by executing an electrodeposition coating analysis; and predicting a paint film thickness of the object car based on a previously-prepared correlation predicting expression and the calculated paint film thickness of the constituent member.

2. The method of claim 1, wherein the correlation predicting expression stipulates a correlation between the paint film thickness of the object car and the calculated paint film thickness of the constituent member.

3. The paint film thickness predicting method of claim 1, wherein the correlation predicting expression is based upon a constituent member constituting a part of a mass-produced car that is same as the constituent member constituting a part of the object car.

4. The paint film thickness predicting method of claim 1, wherein said correlation predicting expression comprises a function using at least the paint film thickness of the constituent member as an input variable.

5. The paint film thickness predicting method of claim 3, wherein said correlation predicting expression comprises a function using at least the paint film thickness of the constituent member as an input variable.

6. The paint film thickness predicting method of claim 1, wherein said predicting comprises using a neural network using at least the calculated paint film thickness of the constituent member as an input variable.

7. The paint film thickness predicting method of claim 3, wherein said predicting, comprises using a neural network using at least the calculated paint film thickness of the constituent member as an input variable.

8. The paint film thickness predicting method of claim 1, wherein the predicting comprises correcting the prediction of the paint film thickness of the object car based on one of a electrodeposition equipment condition and an electrodeposition solution characteristic.

9. The paint film thickness predicting method of claim 3, wherein the predicting comprises correcting the prediction of the paint film thickness of the object car based on one of a electrodeposition equipment condition and an electrodeposition solution characteristic.

10. The paint film thickness predicting method of claim 4, wherein the predicting comprises correcting the prediction of the paint film thickness of the object car based on one of a electrodeposition equipment condition and an electrodeposition solution characteristic.

11. The paint film thickness predicting method of claim 6, wherein the predicting comprises correcting the prediction of the paint film thickness of the object car based on one of an electrodeposition equipment condition and an electrodeposition solution characteristic.

12. The paint film thickness predicting method of claim 5, wherein the predicting comprises correcting the prediction of the paint film thickness of the object car based on one of a electrodeposition equipment condition and an electrodeposition solution characteristic.

13. The paint film thickness predicting method of claim 7, wherein the predicting comprises correcting the prediction of the paint film thickness of the object car based on one of a electrodeposition equipment condition and an electrodeposition solution characteristic.

14. The paint film thickness predicting method of claim 8, wherein the correcting the prediction comprises using a neural network that employs at least one of an electrodeposition equipment condition and an electrodeposition solution characteristic as an input variable.

15. The paint film thickness predicting method of claim 10, wherein the correcting the prediction comprises using a neural network that employs at least one of an electrodeposition equipment condition and an electrodeposition solution characteristic as an input variable.

16. The paint film thickness predicting method of claim 11, wherein the correcting the prediction comprises using a neural network that employs at least one of an electrodeposition equipment condition and an electrodeposition solution characteristic as an input variable.

17. The paint film thickness predicting method of claim 12, wherein the correcting the prediction comprises using a neural network that employs at least one of an electrodeposition equipment condition and an electrodeposition solution characteristic as an input variable.

18. The paint film thickness predicting method of claim 1, wherein the calculating comprises:

generating an analysis mesh for the constituent member, and preventing an electrodeposition solution from entering from an outside to the analysis mesh.

19. The paint film thickness predicting method of claim 17, wherein the calculating comprises:

generating an analysis mesh for the constituent member, and preventing an electrodeposition solution from entering from an outside to the analysis mesh.

20. A paint film thickness predicting system for an object car, comprising:

a memory device that stores a correlation predicting expression that stipulates a correlation between the paint film thickness of the object car and the paint film thickness of a constituent member of the object car; and a computer that calculates the paint film thickness of the constituent member by executing the electrodeposition coating analysis, and then predicts the paint film thickness of the object car based on the correlation predicting expression and the paint film thickness of the constituent member.

21. A recording medium for recording a program that causes a computer to predict a paint film thickness of an object car, the program comprising:

instructions for calculating the paint film thickness of a constituent member of the object car by executing electrodeposition coating analysis; and instructions for predicting the paint film thickness of the object car based on a previously-prepared correlation predicting expression and the paint film thickness of the constituent member.

22. The method of claim 21, wherein the correlation predicting expression stipulates a correlation between the paint film thickness of the object car and the calculated paint film thickness of the constituent member.

* * * * *